US012163206B2

(12) United States Patent
Alexander et al.

(10) Patent No.: US 12,163,206 B2
(45) Date of Patent: Dec. 10, 2024

(54) ALUMINUM ALLOY

(71) Applicant: FNA Group, Inc., Pleasant Prairie, WI (US)

(72) Inventors: Gus Alexander, Inverness, IL (US); Richard J. Gilpatrick, Burlington, WI (US)

(73) Assignee: FNA GROUP, INC., Pleasant Prairie, WI (US)

( * ) Notice: Subject to any disclaimer, the term of this patent is extended or adjusted under 35 U.S.C. 154(b) by 0 days.

(21) Appl. No.: 16/173,137

(22) Filed: Oct. 29, 2018

(65) Prior Publication Data

US 2020/0131605 A1 Apr. 30, 2020

(51) Int. Cl.

| | |
|---|---|
| ***C22C 21/02*** | (2006.01) |
| ***F04B 1/04*** | (2020.01) |
| ***F04B 1/0408*** | (2020.01) |
| ***F04B 17/05*** | (2006.01) |
| *F04B 1/14* | (2020.01) |

(52) U.S. Cl.

CPC ..... *C22C 21/02* (2013.01); *F04B 1/0408* (2013.01); *F04B 17/05* (2013.01); *F04B 1/14* (2013.01)

(58) Field of Classification Search

None

See application file for complete search history.

(56) References Cited

U.S. PATENT DOCUMENTS

2015/0098859 A1* 4/2015 Hauck ..... B22D 21/007 420/532
2017/0121793 A1* 5/2017 Kaburagi ..... C22C 21/02
2019/0293120 A1* 9/2019 Schmitt ..... B32B 15/012

FOREIGN PATENT DOCUMENTS

CN 103031473 A * 4/2013
DE 102006039684 A1 * 2/2008 ..... C22C 21/02
JP 2003343353 A * 12/2003
JP 2006322032 A * 11/2006
JP 2015157588 A * 9/2015
WO WO-2018015126 A1 * 1/2018 ..... F16C 33/124

OTHER PUBLICATIONS

"Introduction to Aluminum and Aluminum Alloys." ASM Speciality Handbook: Aluminium and Aluminium Alloys, by J. R. Davis, ASM, 1993, pp. 40-46. (Year: 1993).*

* cited by examiner

*Primary Examiner* — Anthony M Liang
(74) *Attorney, Agent, or Firm* — Brian J. Colandreo; Jeffrey T. Placker; Holland & Knight LLP

(57) ABSTRACT

An aluminum alloy is provided including between about 7.5-9.5 wt. % silicon, between about 3.0-4.0 wt. % copper, and between about 0.01-5.0 wt. % titanium. The aluminum alloy may include up to about 1.3 wt. % iron, up to about 0.5 wt. % manganese, up to about 0.1 wt. % magnesium, up to about 3.0 wt. % zinc, and up to about 0.35 wt. % tin. The balance of the aluminum alloy may include aluminum.

13 Claims, 1 Drawing Sheet

| % | Cu | Mg | Zn | Fe | Mn | Ni | Ti | Pb | Sn | Cr | Al | Si | Hg |
|---|---|---|---|---|---|---|---|---|---|---|---|---|---|
| | Copper | Magnesium | Zinc | Iron | Manganese | Nickel | Titanium | Lead | Tin | Chromium | Aluminum | Silicon | Mercury |
| 1 | 3.59 | 0.069 | 0.81 | 1.09 | 0.25 | 0.026 | 0.094 | 0.019 | 0.020 | 0.070 | 65.1 | 8.71 | <0.002 |
| 2 | 3.81 | 0.070 | 0.81 | 1.00 | 0.22 | 0.026 | 0.091 | 0.023 | 0.015 | 0.045 | 65.0 | 8.74 | <0.002 |
| 3 | 3.72 | 0.069 | 0.81 | 0.93 | 0.20 | 0.025 | 0.091 | 0.018 | 0.014 | 0.044 | 65.2 | 8.74 | <0.002 |
| Min Acc | 3.00 | - | - | - | - | - | 0.010 | - | - | - | - | 7.50 | - |
| Rep | 3.71 | 0.069 | 0.81 | 1.01 | 0.22 | 0.025 | 2.505 | 0.020 | 0.017 | 0.053 | 65.1 | 8.73 | <0.002 |
| Max Acc | 4.00 | 0.100 | 3.00 | 1.30 | 0.50 | 0.50 | 5.000 | - | 0.35 | - | - | 9.50 | - |

| % | Ca | Cd | Zr | Ag | Sr | Be | Sb | Co | Li | B | Na | Sc | V |
|---|---|---|---|---|---|---|---|---|---|---|---|---|---|
| | Calcium | Cadmium | Zirconium | Silver | Strontium | Beryllium | Antimony | Cobalt | Lithium | Boron | Sodium | Scandium | Vanadium |
| 1 | 0.018 | 0.004 | 0.006 | 0.0007 | <0.0001 | 0.0007 | 0.001 | 0.001 | <0.0002 | 0.003 | >0.022 | <0.050 | 0.019 |
| 2 | 0.021 | 0.009 | 0.005 | 0.0005 | <0.0001 | 0.0007 | 0.006 | <0.0010 | <0.0002 | 0.002 | >0.022 | <0.050 | 0.015 |
| 3 | 0.017 | 0.002 | 0.005 | 0.0006 | <0.0001 | 0.0006 | 0.012 | <0.0010 | <0.0002 | 0.000 | >0.022 | <0.050 | 0.014 |
| Min Acc | - | - | - | - | - | - | - | - | - | - | - | - | - |
| Rep | 0.019 | 0.005 | 0.005 | 0.0006 | <0.0001 | 0.0007 | 0.001 | 0.001 | <0.0002 | 0.002 | >0.022 | <0.050 | 0.015 |
| Max Acc | - | - | - | - | - | - | - | - | - | - | - | - | - |

| % | Ga | Mo | Si | La | Ce |
|---|---|---|---|---|---|
| | Gallium | Molybdenum | Silicon | Lanthanum | Cerium |
| 1 | 0.015 | 0.005 | 0.005 | 0.0008 | <0.002 |
| 2 | 0.015 | 0.006 | 0.006 | 0.002 | 0.005 |
| 3 | 0.015 | 0.004 | 0.006 | 0.0003 | <0.002 |
| Min Acc | - | - | - | - | - |
| Rep | 0.015 | 0.005 | 0.006 | 0.001 | 0.003 |
| Max Acc | - | - | - | - | - |

| % | Cu | Mg | Zn | Fe | Mn | Ni | Ti | Pb | Sn | Cr | Al | Si | Hg |
|---|---|---|---|---|---|---|---|---|---|---|---|---|---|
| | Copper | Magnesium | Zinc | Iron | Manganese | Nickel | Titanium | Lead | Tin | Chromium | Aluminium | Silicon | Mercury |
| **1** | 3.59 | 0.069 | 0.81 | 1.09 | 0.25 | 0.026 | 0.094 | 0.019 | 0.020 | 0.070 | 65.1 | 8.71 | <0.002 |
| **2** | 3.81 | 0.070 | 0.81 | 1.00 | 0.22 | 0.026 | 0.091 | 0.023 | 0.015 | 0.045 | 65.0 | 8.74 | <0.002 |
| **3** | 3.72 | 0.069 | 0.81 | 0.93 | 0.20 | 0.025 | 0.091 | 0.018 | 0.014 | 0.044 | 65.2 | 8.74 | <0.002 |
| **Min Acc** | 3.00 | - | - | - | - | - | 0.010 | - | - | - | - | 7.50 | - |
| **Rep** | 3.71 | 0.069 | 0.81 | 1.01 | 0.22 | 0.025 | 2.505 | 0.020 | *0.017* | *0.053* | *65.1* | 8.73 | <0.002 |
| **Max Acc** | 4.00 | 0.100 | 3.00 | 1.30 | 0.50 | 0.50 | 5.000 | - | 0.35 | - | - | 9.50 | - |

| % | Ca | Cd | Zr | Ag | Sr | Be | Sb | Co | Li | B | Na | Sc | V |
|---|---|---|---|---|---|---|---|---|---|---|---|---|---|
| | Calcium | Cadmium | Zirconium | Silver | Strontium | Beryllium | Antimony | Cobalt | Lithium | Boron | Sodium | Scandium | Vanadium |
| **1** | 0.018 | 0.004 | 0.006 | 0.0007 | <0.0001 | 0.0007 | 0.001 | 0.001 | <0.0002 | 0.003 | >0.022 | <0.050 | 0.019 |
| **2** | 0.021 | 0.009 | 0.005 | 0.0005 | <0.0001 | 0.0007 | 0.006 | <0.0010 | <0.0002 | 0.002 | >0.022 | <0.050 | 0.015 |
| **3** | 0.017 | 0.002 | 0.005 | 0.0006 | <0.0001 | 0.0006 | 0.012 | <0.0010 | <0.0002 | 0.000 | >0.022 | <0.050 | 0.014 |
| **Min Acc** | - | - | - | - | - | - | - | - | - | - | - | - | - |
| **Rep** | 0.019 | 0.005 | 0.005 | 0.0006 | <0.0001 | 0.0007 | 0.001 | 0.001 | <0.0002 | 0.002 | >0.022 | <0.050 | 0.015 |
| **Max Acc** | - | - | - | - | - | - | - | - | - | - | - | - | - |

| % | Ga | Mo | Si | La | Ce |
|---|---|---|---|---|---|
| | Gallium | Molybdenum | Silicon | Lanthanum | Cerium |
| **1** | 0.015 | 0.005 | 0.005 | 0.0008 | <0.002 |
| **2** | 0.015 | 0.006 | 0.006 | 0.002 | 0.005 |
| **3** | 0.015 | 0.004 | 0.006 | 0.0003 | <0.002 |
| **Min Acc** | - | - | - | - | - |
| **Rep** | 0.015 | 0.005 | 0.006 | 0.001 | 0.003 |
| **Max Acc** | - | - | - | - | - |

ALUMINUM ALLOY

TECHNICAL FIELD

The present invention generally relates to aluminum alloys, and more particularly relates to aluminum alloys that may be suitable for die casting, for example, pumps.

BACKGROUND

Pressure washer pumps often utilize positive displacement pumps, such as piston pumps. With each pumping cycle, as water is displaced from the pump chamber, the pressure in the pump system, e.g., including the pump chamber and the high pressure manifold that conveys water from the pump chamber to a pump outlet, may rise, resulting in a stress surge on the pump system. As the pressure washer pump may cycle from hundreds to thousands of times per minute, and may be sustained over long periods of usage of the pressure washer, the pressure washer pump system may experience fatigue, that can result in cracking and failure over time.

Extending the useful life for pressure washer systems, particularly commercial grade pressure washers that may operate at pressures above 3400 psi, has often necessitated the use of expensive materials and/or manufacturing processes. For example, while die casting may provide a cost effective manufacturing process for pressure washer pump components, the materials, such as conventional die casting aluminum alloys, available for manufacturing pressure washer pump components may not exhibit the strength and fatigue resistance to provide a desired service life for a pressure washer pump. Therefore, it has often been necessary to utilize pump components made from forged brass or stainless steel to achieve a desired service life, resulting in a heavier and more expensive pressure washer pump.

SUMMARY

In an embodiment an aluminum alloy may include between about 7.5-9.5 wt. % silicon, between about 3.0-4.0 wt. % copper, and between about 0.01-5.0 wt. % titanium. The aluminum alloy may include up to about 1.3 wt. % iron, up to about 0.5 wt. % manganese, up to about 0.1 wt. % magnesium, up to about 3.0 wt. % zinc, and up to about 0.35 wt. % tin. The balance of the aluminum alloy may be aluminum.

One or more of the following features may be included. The aluminum alloy may include between about 0.09-1.0 wt. % titanium. The aluminum alloy may include about 8.7 wt. % silicon. The aluminum alloy may include about 3.7 wt. % copper. The aluminum alloy may include about 1.0 wt. % iron. The aluminum alloy may include about 0.2 wt. % manganese. The aluminum alloy may include about 0.07 wt. % magnesium.

The aluminum alloy may include about 0.8 wt. % zinc. The aluminum alloy may include about 0.02 wt. % tin. The aluminum alloy may further include about 0.02 wt. % lead. The aluminum alloy may further include about 0.5 wt. % chromium. The aluminum alloy may further include up to about 0.02 wt. % each of one or more of calcium, cadmium, zirconium, silver, strontium, beryllium, antimony, cobalt, lithium, boron, sodium, scandium, vanadium, gallium, molybdenum, lanthanum, and cerium.

According to another implementation, a pressure washer pump may include a high pressure manifold for conveying a flow a high pressure fluid from a pump chamber to a pump outlet. The high pressure manifold may include a first cast aluminum alloy feature. The aluminum alloy may include between about 7.5-9.5 wt. % silicon, between about 3.0-4.0 wt. % copper, and between about 0.01-5.0 wt. % titanium. The aluminum alloy may include up to about 1.3 wt. % iron, up to about 0.5 wt. % manganese, up to about 0.1 wt. % magnesium, up to about 3.0 wt. % zinc, and up to about 0.35 wt. % tin. The balance of the aluminum alloy may include aluminum.

One or more of the following features may be included. The aluminum alloy may include between about 0.09-1.0 wt. % titanium. The pressure washer pump may also include a low pressure manifold for conveying a flow of low pressure fluid from a pump inlet to the pump chamber. The low pressure manifold may include a second cast aluminum alloy feature. The aluminum alloy may include between about 7.5-9.5 wt. % silicon, between about 3.0-4.0 wt. % copper, and between about 0.01-0.2 wt. % titanium. The aluminum alloy may include up to about 1.3 wt. % iron, up to about 0.5 wt. % manganese, up to about 0.1 wt. % magnesium, up to about 3.0 wt. % zinc, and up to about 0.35 wt. % tin. The balance of the aluminum alloy may include aluminum. The high pressure manifold and the low pressure manifold may include a common cast aluminum alloy structure including the first cast aluminum alloy feature and the second cast aluminum alloy feature. The pressure washer pump may include a pump housing formed as a cast aluminum alloy structure, wherein the high pressure manifold is at least partially integrally cast with pump housing.

According to another implementation, a pressure washer pump may include a pump housing comprising a die cast aluminum alloy structure. The aluminum alloy may include between about 7.5-9.5 wt. % silicon, between about 3.0-4.0 wt. % copper, and between about 0.01-5.0 wt. % titanium. The aluminum alloy may include up to about 1.3 wt. % iron, up to about 0.5 wt. % manganese, up to about 0.1 wt. % magnesium, up to about 3.0 wt. % zinc, and up to about 0.35 wt. % tin. the balance of the aluminum alloy may include aluminum.

One or more of the following features may be included. The aluminum alloy may include between about 0.09-1.0 wt. % titanium. The aluminum alloy may further include about 8.7 wt. % silicon, about 3.7 wt. % copper, about 1.0 wt. % iron, about 0.2 wt. % manganese, about 0.07 wt. % magnesium, about 0.8 wt. % zinc, about 0.02 wt. % tin, about 0.02 wt. % lead, and about 0.5 wt. % chromium. The aluminum alloy may include up to about 0.02 wt. % each of one or more of calcium, cadmium, zirconium, silver, strontium, beryllium, antimony, cobalt, lithium, boron, sodium, scandium, vanadium, gallium, molybdenum, lanthanum, and cerium.

BRIEF DESCRIPTION OF THE DRAWINGS

FIG. 1 is a table depicting illustrative example aluminum alloy formulations consistent with the present disclosure.

DETAILED DESCRIPTION OF EXAMPLE EMBODIMENTS

In general, the present disclosure provides aluminum alloy compositions that may suitably be used for die casting processes, as well as various other casting, forming and production operations. Consistent with some embodiments, the aluminum alloy may exhibit increased overall durability as compared to many conventional die casting aluminum alloys, particularly when used in applications that may experience relatively high part stress. Additionally, in some embodiments, the aluminum alloy may exhibit a relatively high degree of fatigue resistance in die cast components that may experience relatively high stress cycling, particularly over sustained periods of time. According to a particular illustrative implementations, components of a pressure washer pump may advantageously be provided as die cast components formed from aluminum alloy compositions of the present disclosure. In some implementations, a high pressure manifold may be provided as a die cast component formed from aluminum alloy compositions of the present disclosure. In some implementations, additional features of the pressure washer pump may also be formed as die cast components including aluminum alloy compositions of the present disclosure, including features that may be integrally formed with the high pressure manifold, as a common casting. Various additional and/or alternative features and characteristics may be implemented consistent with the present disclosure.

According to an illustrative example embodiment, an aluminum alloy is provided. In some implementations, the aluminum alloy may be suitable for use in die casting processes, however the aluminum alloy may also be utilized in connection with various additional and/or alternative manufacturing, shaping, and forming processes. In the illustrative embodiment, the aluminum alloy may generally include between about 7.5-9.5 wt. % of silicon, between about 3.0-4.0 wt. % of copper, and between about 0.01-5.0 wt. % titanium. Further, the aluminum alloy may include up to about 1.3 wt. % iron, up to about 0.5 wt. % manganese, up to about 0.1 wt. % magnesium, up to about 3.0 wt. % zinc, and up to about 0.35 wt. % tin. The balance of the aluminum alloy may be aluminum.

In some implementations, an aluminum alloy consistent with the present disclosure may generally exhibit desirable die casting performance, desirable strength, resistance to inclusions, air bubbles, and porosity, as well as many other characteristics, that may be generally similar to ANSI A380 aluminum alloy. However, an aluminum alloy consistent with the present disclosure may generally exhibit a greater yield strength and decreased elongation relative to A380 alloys. Accordingly, the inclusion of titanium in an aluminum alloy consistent with the present disclosure may provide certain property differences that may be particularly advantageous in certain applications. Further, an aluminum alloy consistent with the present disclosure may avoid certain drawbacks of typical high strength die casting aluminum alloys, such as ANSI A390. For example, while A390 may exhibit a relatively high yield strength, and a relatively low elongation, A390 may exhibit less desirable machinability. For example, A390 was particularly formulated for use in internal combustion engine blocks. In achieving the desired properties for use in die cast engine blocks, A390 is formulated with a relatively high amount of silicon, which may adversely affect the machinability of any resultant die cast parts. Additionally, the relatively high level of silicon may adversely affect the coloration of die cast part when subjected to anodizing. By contrast to A390, an aluminum alloy consistent with the present disclosure may include on the order of about half as much silicon as is typical in A390. It should be appreciated that the forgoing description of the relative silicon content is intended to express a general comparative order, rather than an exact quantity, as both an aluminum alloy consistent with the present disclosure and A390 may each include a range of silicon content.

Referring to FIG. 1, illustrative example aluminum alloy formulations consistent with the present disclosure are shown. It will be appreciated that the specific embodiments are intended for the purpose of illustration, and should not be construed as limiting the full scope of the invention. Similarly, the identified "Min Acc" and "Max Acc" are provided in the context of the particular illustrative embodiments of FIG. 1. Further, it will also be noted that the indicator "Rep" identifies a numerical average of the three illustrative example embodiments. As such, Rep should not be construed as a preferred or idealized embodiment. It will be appreciated that variation beyond the illustrated examples may be implemented while achieving useful aspects of the disclosed aluminum alloy.

Consistent with an illustrative embodiment, the aluminum alloy main include between about 0.09-5.0 wt. % titanium. In an example embodiment, the aluminum alloy may include about 8.7 wt. % silicon. In an example embodiment, the aluminum alloy may include about 3.7 wt. % copper. In one embodiment, the aluminum alloy may include about 1.0 wt. % iron. In an embodiment, the aluminum alloy may include about 0.2 wt. % manganese. In an embodiment, the aluminum alloy may include about 0.07 wt. % magnesium. Additionally, the aluminum alloy may include about 0.8 wt. % zinc. The aluminum alloy may include about 0.02 wt. % tin. The aluminum alloy may further include about 0.02 wt. % lead. The aluminum alloy may further include about 0.5 wt. % chromium.

Additionally, it will be appreciated that in many embodiments a variety of additional alloying elements may also be included. For example, the aluminum alloy may further include up to about 0.02 wt. % each of one or more of calcium, cadmium, zirconium, silver, strontium, beryllium, antimony, cobalt, lithium, boron, sodium, scandium, vanadium, gallium, molybdenum, lanthanum, and cerium.

It will be appreciated that any disclosure of ranges herein is susceptible to minor variation and/or alteration with departing from the scope of the invention. Further, it will be appreciated that any alloying element described as having a content "up to" a specified quantity may be omitted from the aluminum alloy, in certain embodiments.

As generally discussed above, in an illustrative example embodiment, an aluminum alloy consistent with the present disclosure may be utilized for at least some die cast components of a pressure washer pump. As is generally known, a pressure washer may generally be connected to a relatively low pressure water supply, such as a residential or commercial water supply, such as a municipal water supply or the like. The pressure washer may utilize an engine or motor driven pump to increase the relatively low pressure water supply to a high pressure water output. For example, a pressure washer may often receive a water supply having a pressure in the tens of psi and provide a high pressure output in the thousands of psi. Often pressure washers may utilize positive displacement pumps to provide the desired increase in water pressure. Such positive displacement pumps may exhibit cyclic pressure loads. For example, a common positive displacement pump used in a pressure washer is a piston pump. In some pressure washer applications, a piston pump may operate at more than 500 rpm (e.g., an engine or motor driving the pump may operate at more than 500 rpm, and may drive the piston pump through a corresponding number of cycles per minute), and in some situations may operate at speeds up to 5000 rpm. However, it will be appreciated that such operating parameters are presented for the purpose of illustration.

Each pumping cycle of the piston pump may result in a corresponding pressure spike within the pressure washer pump, particularly, for example, within the high pressure outlet manifold that may receive the high pressure water from the pump chamber (e.g., the pump cylinder) and direct the high pressure waster to the pump outlet. Based upon the operating speed of the pressure washer, the pressure washer pump (e.g., the high pressure manifold, pump housing, pump chamber/cylinder, etc.) may experience, for example, between 500 and 5000 pressure spikes per minute. These pressure cycles may be sustained for an extended period of time, such as hours per use of the pressure washer. Over the life of the pressure washer, pressure cycles experienced by the pressure washer pump can result in significant fatigue, which may lead to cracking or other failures, of high pressure components of the pressure washer, such as the high pressure manifold, the pump chamber/cylinder, as well as various other components of the pressure washer.

Particularly in the case of pressure washers with operating pressure exceeding 3400 psi, the problems associated with the sustained pressure cycles has been addressed through the use of heavy and expensive components, such as high pressure manifolds made from forged brass or stainless steel. Consistent with aspects of the present disclosure, high pressure components of a pressure washer may be provided as die cast articles formed from the aluminum alloys described herein. As such, a pressure washer pump may be provided using lighter weight, lower cost, and more quickly produced die cast components, such as high pressure manifolds, pump chambers/cylinders, etc., because the aluminum alloys herein may generally exhibit an increased yield strength, decreased, elongation, and overall improved durability as compared to known die cast grade aluminum alloys, without sacrificing machinability, which may be desirable for post-casting shaping and finishing operations.

Furthermore, in some embodiments, the surface hardness of die cast components made using aluminum alloys disclosed herein may be enhanced by Hardcoat Anodizing (also referred to as Type III anodizing (as denoted by MIL-A-8625 specification)). A surface treatment process of this variety may further harden the composition of the pump head but it may not be necessary and/or desirable in all cases. The relatively lower silicon content, e.g., as compared to some high yield strength die cast grade aluminum alloys, may have little to no effect on coloration when the component is subject to anodization.

Continuing with the foregoing, according to an illustrative example embodiment, a pressure washer pump may include a high pressure manifold for conveying a flow a high pressure fluid from a pump chamber to a pump outlet. The high pressure manifold may include a first cast aluminum alloy feature (e.g., a die cast feature or component). The aluminum alloy may include between about 7.5-9.5 wt. % of silicon, between about 3.0-4.0 wt. % of copper, and between about 0.01-5.0 wt. % titanium. The aluminum alloy may include up to about 1.3 wt. % iron, up to about 0.5 wt. % manganese, up to about 0.1 wt. % magnesium, up to about 3.0 wt. % zinc, and up to about 0.35 wt. % tin. The balance of the aluminum alloy may include aluminum. In some particular embodiments, the aluminum alloy may include between about 0.1 to about 1.0 wt. % titanium. In some particular embodiments, the aluminum alloy may include between about 0.7 to about 0.2 wt. % titanium. In some particular embodiments, the aluminum alloy may include between about 0.9 to about 1.5 wt. % titanium. In some particular embodiments, the aluminum alloy may include between about 0.09-0.1 wt. % titanium.

As discussed above, in some implementations, a pressure washer may include features in addition to the high pressure manifold that may benefit from the use of an aluminum alloy consistent with the present disclosure, e.g., which may provide relatively high yield strength, relatively low elongation, and an overall high durability, while still permitting relatively fast and cost effective production through die casting. Additionally, often many features and/or aspects of a pressure washer pump may integrally formed and/or formed as part of a single, common casting. For example, often a pressure washer pump head, e.g., which may include the high pressure manifold, the lower pressure (e.g., intake) manifold, pump chamber/cylinder, and/or many other features of the pressure washer pump, may be formed as a single casting. In some embodiments, the single casting may undergo various subsequent machining or finishing operations, such as impregnation (e.g. to fill micro-crack and micro-porosity in the casting and to enhance the integrity of the casting), e.g., to fully form the various features. As such, many features of the pressure washer pump may be formed from a single die cast component.

In an example embodiment, the pressure washer pump may also include a low pressure manifold for conveying a flow of low pressure fluid from a pump inlet to the pump chamber. The low pressure manifold may include a second cast aluminum alloy feature. The aluminum alloy may include between about 7.5-9.5 wt. % of silicon, between about 3.0-4.0 wt. % of copper, and between about 0.01-5.0 wt. % titanium. The aluminum alloy may include up to about 1.3 wt. % iron, up to about 0.5 wt. % manganese, up to about 0.1 wt. % magnesium, up to about 3.0 wt. % zinc, and up to about 0.35 wt. % tin. The balance of the aluminum alloy may include aluminum. Further, in some embodiments, the high pressure manifold and the low pressure manifold may include a common cast aluminum alloy structure including the first cast aluminum alloy feature and the second cast aluminum alloy feature. In a particular example embodiment, the pressure washer pump may include a pump housing formed as a die cast aluminum alloy structure. One or more of the high pressure manifold and the low pressure manifold may be integrally cast with the pump housing, e.g., as a single die cast component, and/or may be formed as separate components that may be joined to with the pump housing (e.g., via mechanical fasteners, such as bolts, and/or otherwise coupled to the pump housing).

While some of the foregoing example embodiments have been described in the context of pressure washers and pressure washer pumps, it will be appreciated that the principles, features, and/or advantages described herein may be equally applicable to other types of pumps, pump manifolds, and the like. It will further be appreciated that aluminum alloys disclosed herein, which may provide materials suitable for die casting, may also suitably be susceptible to other manufacturing and/or forming processes. Further, aluminum alloys disclosed herein may be suitably used in connection with products and articles of manufacture unrelated to pressure washers and/or pressure washer pumps, which may benefit from any of the characteristics and/or attributes provided by the disclosed aluminum alloys. Further, while various discrete embodiments have been described herein, it will be appreciated that various aspects of the individual embodiments may be combined with aspects of other embodiments, with such combination being contemplated by the present disclosure. Accordingly, the present disclosure should not be limited by any of the disclosed example embodiments, and should be afforded the full scope of the appended claims.

What is claimed is:

1. An aluminum alloy comprising:
between about 7.5 wt. %-9.5 wt. % silicon;
between about 3.0 wt. %-4.0 wt. % copper;
up to about 1.3 wt. % iron;
up to about 0.5 wt. % manganese;
up to about 0.1 wt. % magnesium;
up to about 3.0 wt. % zinc;
up to about 0.35 wt. % tin;
between about 0.9 wt. %-1.5 wt. % titanium;
between about 0.001 wt. %-0.02 wt. % antimony;
one or more of:
between about 0.0005 wt. %-0.0007 wt. % silver;
between about 0.004 wt. %-0.006 wt. % molybdenum;
between about 0.0003 wt. %-0.002 wt. % lanthanum;
up to about 0.02 wt. % each of one or more of strontium, cobalt, lithium, sodium, scandium, vanadium, and cerium;
and
the balance being aluminum.

2. The aluminum alloy according to claim 1, comprising about 8.7 wt. % silicon.

3. The aluminum alloy according to claim 1, comprising about 3.7 wt. % copper.

4. The aluminum alloy according to claim 1, comprising about 1.0 wt. % iron.

5. The aluminum alloy according to claim 1, comprising about 0.2 wt. % manganese.

6. The aluminum alloy according to claim 1, comprising about 0.07 wt. % magnesium.

7. The aluminum alloy according to claim 1, comprising about 0.8 wt. % zinc.

8. The aluminum alloy according to claim 1, comprising about 0.02 wt. % tin.

9. The aluminum alloy according to claim 1, further comprising about 0.02 wt. % lead.

10. The aluminum alloy according to claim 1, further comprising about 0.5 wt. % chromium.

11. The aluminum alloy according to claim 1, further comprising up to about 0.02 wt. % each of one or more of zirconium, beryllium, boron.

12. The aluminum alloy according to claim 1, further comprising between about 0.017 wt. %-0.021 wt. % calcium.

13. An aluminum alloy comprising:
between about 7.5 wt. %-9.5 wt. % silicon;
between about 3.0 wt. %-4.0 wt. % copper;
up to about 1.3 wt. % iron;
up to about 0.5 wt. % manganese;
up to about 0.1 wt. % magnesium;
up to about 3.0 wt. % zinc;
up to about 0.35 wt. % tin;
between about 0.1 wt. %-5 wt. % titanium;
one or more of:
between about 0.001 wt. %-0.012 wt. % antimony;
about 0.02 wt. % each of one or more of strontium, cobalt, lithium, sodium, scandium, vanadium, and cerium; and
the balance being aluminum.

* * * * *